US005999876A

United States Patent [19]

Irons et al.

[11] Patent Number: 5,999,876

[45] Date of Patent: Dec. 7, 1999

[54] METHOD AND SYSTEM FOR COMMUNICATION WITH AN ENGINE CONTROL MODULE IN SLEEP MODE

[75] Inventors: John Irons, Greenwood; Scott Decker, Columbus; Greg Greathouse, Columbus; Irfan Tusneem, Columbus, all of Ind.

[73] Assignee: Cummins Engine Company, Inc., Columbus, Ind.

[21] Appl. No.: 09/053,582

[22] Filed: Apr. 1, 1998

[51] Int. Cl.[6] ..... F02D 45/00

[52] U.S. Cl. ..... 701/115

[58] Field of Search ..... 701/102, 112, 701/115

[56] References Cited

U.S. PATENT DOCUMENTS

| | | |
|---|---|---|
| 4,143,368 | 3/1979 | Route et al. . |
| 4,698,748 | 10/1987 | Juzswik et al. . |
| 5,081,586 | 1/1992 | Barthel et al. . |
| 5,083,266 | 1/1992 | Watanabe . |
| 5,317,751 | 5/1994 | Novakovich et al. . |
| 5,361,392 | 11/1994 | Fourcroy et al. . |
| 5,388,265 | 2/1995 | Volk . |
| 5,454,114 | 9/1995 | Yach et al. . |
| 5,485,625 | 1/1996 | Gumkowski . |
| 5,579,524 | 11/1996 | Kikinis . |
| 5,586,130 | 12/1996 | Doyle ..... 324/110 |
| 5,619,412 | 4/1997 | Hapka . |
| 5,826,205 | 10/1998 | Koelle et al. ..... 701/102 |

*Primary Examiner*—Andrew M. Dolinar
*Attorney, Agent, or Firm*—Baker & Daniels

[57] ABSTRACT

An engine control system for a vehicle engine includes an engine control module (ECM) that enters a modified sleep mode when the vehicle key switch is turned to the "off" position. In the modified sleep mode, all non-essential operating tasks normally executed by the ECM are disabled to place the ECM in a mode of reduced power consumption. In addition, various communications interrupts are disabled, except for interrupts associated with at least one external data transmission device. During the modified sleep mode, priority for communications with the external device are highest to permit external communication to and from the ECM using the external device. In this modified sleep mode, the vehicle operator or engine technician can download or upload data to and from the ECM memory. The ECM includes a sleep mode task module that is maintained during the modified sleep mode. The sleep mode task module controls a sleep mode termination timer (SMT timer) that counts the time the ECM is in the modified sleep mode. The SMT timer is reset for each communication between the ECM and the external device. Upon expiration of the SMT timer, the ECM transfers to a power down mode, after flushing volatile data caches to non-volatile memory.

17 Claims, 4 Drawing Sheets

METHOD AND SYSTEM FOR COMMUNICATION WITH AN ENGINE CONTROL MODULE IN SLEEP MODE

BACKGROUND OF THE INVENTION

The present invention concerns a method and system for data communication with a microprocessor while the microprocessor is in a low-power or "sleep" mode. More specifically, the invention relates to an engine control module for an internal combustion engine that has a sleep mode when the engine is turned off.

In recent years, the control of internal combustion engines has branched away from the traditional mechanical linkage and analog approaches to an electronics or microprocessor based system of controls. In a typical vehicle, the operation of the engine is controlled by an engine control module (ECM) which receives a variety of input signals and output signals monitoring and controlling various components of the engine. For example, the ECM can send signals to a fuel system for controlling the amount of air and/or fuel sent to the engine cylinders. In addition to sending control signals, the ECM also receives signals from various sensors at the engine and drive train. For example, the sensors carry signals indicative of engine speed, fuel and air flow, intake and exhaust pressure, engine temperature, and the like. The ECM uses data related to the signals to calculate various engine operating parameters based upon algorithms contained within the ECM.

In addition, the ECM retains data in memory showing a complete history of the engine performance and operating parameters. For example, the ECM calculates and stores data for engine torque, horsepower, load factors, fuel consumption, duty cycles, cylinder firing times and the like. This information is stored in the ECM to be downloaded at predetermined intervals in the engine life. The downloaded information can be analyzed at a site away from the vehicle to evaluate the engine performance and make recommendations for servicing of the engine.

In contrast to the prior mechanical linkage and analog systems of the past, the electronic controllers and ECMs of the modern engine must be continuously connected to an electrical power source, such as the vehicle battery. Like most microprocessors, the typical engine control module maintains an internal clock, for example, that can maintain date and time of day information. This internal clock operates whether or not the engine and vehicle are being operated. Thus, the ECM usually requires its own hardwired power supply. In addition, the ECM and associated electronic components have generally high input power requirements. While the vehicle is operating, the alternator can easily provide for the power requirements of the ECM and associated components. However, these power requirements reduce fuel economy in proportion to the amount of engine output power that goes into driving the vehicle alternator. At the other end of the spectrum, when the vehicle is not operating, the ECM must draw its power from a storage battery.

In either circumstance, whether the vehicle is operating or idle, it is prudent and usually necessary to conserve the amount of electrical energy consumed by the ECM and its associated components. Consequently, the modern ECM, like the typical personal computer or microprocessor, has a "sleep" mode in which the ECM operates on reduced power. For example, the sleep mode of an ECM can terminate power to all elements of an ECM other than the real time clock. In another example, passenger vehicles that utilize automatic door lock transmitters must power the door lock receivers in the sleep mode to receive a door unlock signal from a transmitter. Since the energy requirements of components of this type are minimal, a vehicle can be maintained in a sleep mode for quite awhile on a typical vehicle storage battery without draining the battery. Similarly, when the engine is operating and the vehicle is on the road, certain portions or functions of the ECM can be directed to the sleep mode to conserve electrical power usage in real operating time. In that instance, software within the ECM determines what essential elements retain electrical power and which elements are disabled to reduce power consumption.

In a typical vehicle, the ECM is placed into the sleep mode when the key switch is turned to the "off" position. In many such systems, the ECM downloads data from volatile memory into non-volatile or flash memory immediately before entering the sleep mode. In these systems, the ECM exits the sleep mode, or returns to normal powered operation, when the key switch is turned to the "on" position, such as when the operator is starting the vehicle engine, or to the "auxiliary" position in which electrical power is provided without starting the engine. Software within the ECM runs through a power up protocol to enable the previously disabled components and initiate normal operation of the ECM. Since solid state electronics are utilized in these ECMs, the entry into and exit from the sleep mode happens in a matter of seconds.

One drawback with the sleep mode of any processor is that it is deaf to any communication other than certain external signals used to force the ECM out of the sleep mode. For example, some passenger vehicles with remote keyless entry transmit a signal to a vehicle sensor that sends a wake up signal to the ECM. In vehicles of this type, the keyless entry signal from the hand held transmitter turns on the ECM and causes it to unlock the doors, turn on the interior lights and begin the initial steps of a start up protocol. Beyond this capability, existing vehicle ECMs have no ability to transmit and receive information concerning engine operation and performance.

This detriment is most prominent in the use of heavy duty vehicles and equipment. In one example, a land mining site utilizes several heavy duty loading vehicles and hauling trucks to convey mined material from the mine site. In this arena, several vehicles are used to provide a continuous flow of material away from the mine site to a construction site, for example. As the hauling vehicles return, they queue up in a ready line at the mine site to await a new load of mined material. In order to preserve fuel and prevent engine overheating, the hauling vehicles are shut down at the ready line until the next load of material is available.

However, in this situation, the continuous activity of the engines requires that they be frequently monitored to discover and address developing problems in engine performance. Thus, the mine site operator will typically take readings of data from the ECM for evaluation while the vehicle is sitting in the ready line. In this circumstance, the vehicle engine must be kept running until the data is extracted. Moreover, in some cases, after the data has been analyzed certain parameter changes in the ECM may be required, which would necessitate a further transmission of data to the ECM. If the engine is shut off, it enters the typical sleep mode in which data communication is not permitted. Thus, the mine site operator is faced with the choice of keeping the engine running with all of the risks inherent with that option, or shutting the engine off and thereby eliminating any chance of recovering performance data from the engine.

SUMMARY OF THE INVENTION

In view of these detriments of prior engine control modules, the present invention contemplates an engine control system that allows data communication during the sleep mode of the ECM. The invention contemplates an ECM configured or programmed to perform a sequence of steps or tasks once the engine key has been turned to the off position, so that the ECM enters a modified sleep mode.

In one embodiment, the initial step of the sleep mode protocol raises the priority of all sleep mode tasks to the highest priority controlled by the ECM task scheduler. The ECM enters the sleep mode task algorithm, in which the first step is to disable all non-essential tasks and various communication interfaces. Typically, disabling the communication interface simply entails disabling the interrupts corresponding to the particular data line. At this point, then, processors that calculate various engine operating parameters are disabled, and communications to and from the engine and its various sensors are disabled.

In the next step of the sleep mode task algorithm, the various volatile memory data caches are flushed to flash memory so that the volatile memory can be used by the sleep mode task module for subsequent steps of the protocol. Next, the sleep mode module reduces the priority of the sleep mode tasks below the priority of certain communication tasks. In a preferred embodiment, only communication with certain external devices is maintained, so that the sleep mode tasks are given a priority below those particular devices. In one specific embodiment, the external data communication devices can include a service tool that can be directly electrically engaged to an input port of the ECM to access various stored parameters implemented by the engine control algorithms. The external devices can also include a remote device, such as a device described in U.S. Pat. No. 5,619,412, assigned to the assignee of the present invention. This remote device can operate by way of a radio link so that no direct electrical connection to the ECM is required.

In one feature of the invention, the sleep mode module includes a sleep mode termination timer (SMT timer). This timer can be preset by the operator to a particular time interval. A counter within the sleep mode module counts up until it reaches the preset timer value. At that point, the sleep mode is terminated and all data communications are disabled in accordance with the normal engine shut down protocol.

In the inventive modified sleep mode, the sleep mode module continuously monitors the key switch to determine if it has been moved to an "on" position. In that event, the sleep mode is exited and the ECM restart tasks are commenced. In the modified sleep mode, the ECM continuously monitors the enabled communication lines or interrupts. If an interrupt is received on one of the lines signifying data transmission, then the sleep mode termination timer is reset so that a new sleep mode time period is initiated. In addition, at that point, a data flag is set to indicate that data has been changed, assuming that the data communication is to access and modify stored data within the ECM.

Alternatively, the data access to the ECM that causes the exit from the sleep mode can simply be a request to download various information stored in memory in the ECM indicative of engine performance and operating conditions. If the engine operating parameters are modified, a further step of the sleep mode algorithm saves this data to non-volatile memory, in the event that power is completely terminated to the ECM, such as might occur by removal of the vehicle battery.

In accordance with the present invention, the engine control system, and particularly the sleep mode task module, presents a modified sleep mode relative to the typical sleep mode of ECMs and other processors of this type. The present invention permits some limited access to data stored within the ECM. Thus, the vehicle operator can access the ECM to download performance data and to change engine operating variables as required in view of the performance data. All of these steps can occur even though the vehicle is otherwise shutdown and the engine is no longer operating.

It is therefore one object of the present invention to provide an engine control system that permits some data communication with an electronic controller when the controller is in a sleep mode. A further object is to provide a sleep mode protocol that maintains the predetermined sleep mode for a sufficient time to allow data download and upload.

One benefit of the present invention is that a vehicle does not need to be maintained running in order to permit access to the data stored within an ECM. Another benefit is realized in features of the invention that maintain the modified sleep mode for a meaningful period of time and that allow re-initiation of the modified sleep mode as new data communication is sought with the ECM.

Further objects and benefits of the present invention can be discerned from the following written description and its accompanying figures.

DESCRIPTION OF THE PREFERRED EMBODIMENT

Figure 1:
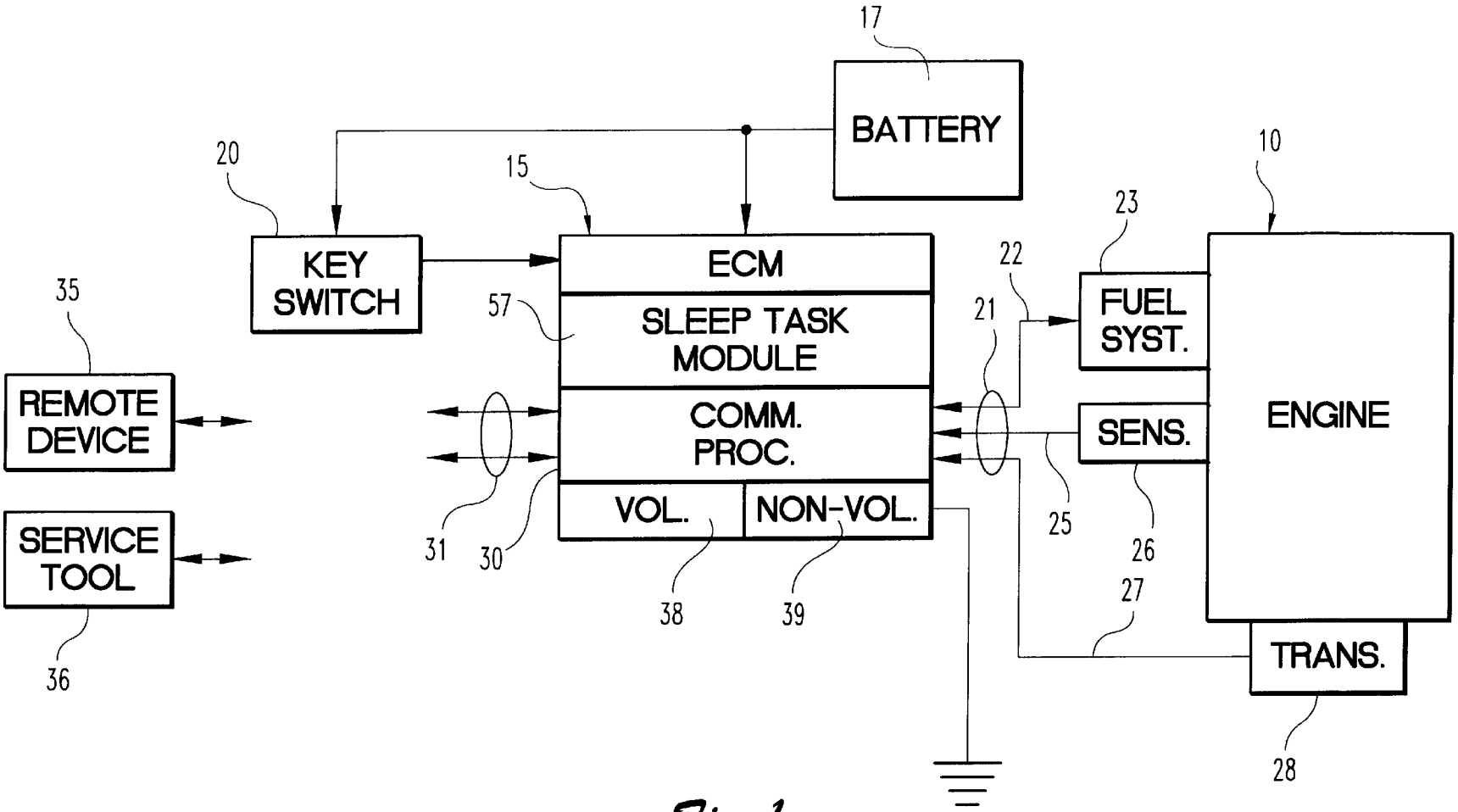
FIG. 1 is a schematic representation of an engine and engine control system, including external devices used to send and receive data to the engine control module.

For the purposes of promoting an understanding of the principles of the present invention, reference will now be made to the embodiments illustrated in the drawings and described herein. It is understood that no limitation of the scope of the invention is intended by the specific figures and description. Alterations and modifications of the illustrated system and method as would occur to persons of ordinary skill in the art are contemplated.

The present invention contemplates a sleep mode module operable within an engine control module (ECM). One advantage of the present invention is that it permits data communication between the ECM and an external tool or device even after the engine has been shut down. With this feature, a vehicle operator can perform various data functions relative to the engine and its operation, while allowing the engine to remain off, rather than running the engine at idle. These aspects of the invention reduce the wear and tear on the engine and eliminate the drain on fuel consumption that accompanies having to maintain the engine running in order to download or upload data from the ECM.

As described above, the present invention is particularly contemplated for use with an engine control module (ECM)

for an internal combustion engine. As shown in FIG. 1, the ECM 15 provides control signals 22 to a fuel system 23 operatively associated with the engine 10. The ECM can be of many known designs to implement a variety of engine control algorithms. The ECM 15 can provide signals 22 specially conditioned to the input requirements of the fuel system 23, which are themselves a function of the type of engine 10 being controlled.

In addition, the ECM 15 receives data signals 21 from the vehicle transmission 28 and various engine performance sensors 26. These sensors 26 monitor various engine operating conditions, such as engine speed, vehicle speed, engine temperature, exhaust pressure, etc. Data from the sensors are used by the algorithms within the ECM 15 to change settings of the fuel system 23 as may be necessary to optimize engine performance.

The ECM 15 includes a volatile or short-term memory 38 which serves as temporary storage for data received by the ECM or used in performance calculations. A non-volatile memory 39 is also provided for long-term, or permanent, storage of the ECM algorithms, pre-determined constants, long term data, and the like. The non-volatile memory 39 is maintained by battery power after the key switch is moved to the "off" position, while data in the volatile memory 38 is lost.

The ECM also includes a communications processor 30 that manages the data signals 21 received by and sent from the ECM. In addition, the communications processor 30 controls communications from various external devices on data lines 31. On such external device is a remote device 35 that allows an vehicle operator or engine technician to evaluate or modify data stored in the ECM without direct connection to the ECM. Alternatively, a hand held service tool 36 can generate external communications with the ECM by directly physically plugging into a data port of the ECM.

The ECM 15 includes a task scheduler that determines the priority of the tasks performed by the ECM. As with a typical microprocessor, the task scheduler gives precedence to higher priority tasks over lower priority tasks. Moreover, certain higher priority tasks occur more frequently than lower tasks depending upon the task scheduler protocol. The ECM is powered by a battery 17, and its initialization is controlled by a vehicle key switch 20. Turning the key switch 20 to the "on" or "auxiliary" positions causes the ECM to initialize and commence its several processing tasks.

Figure 2:
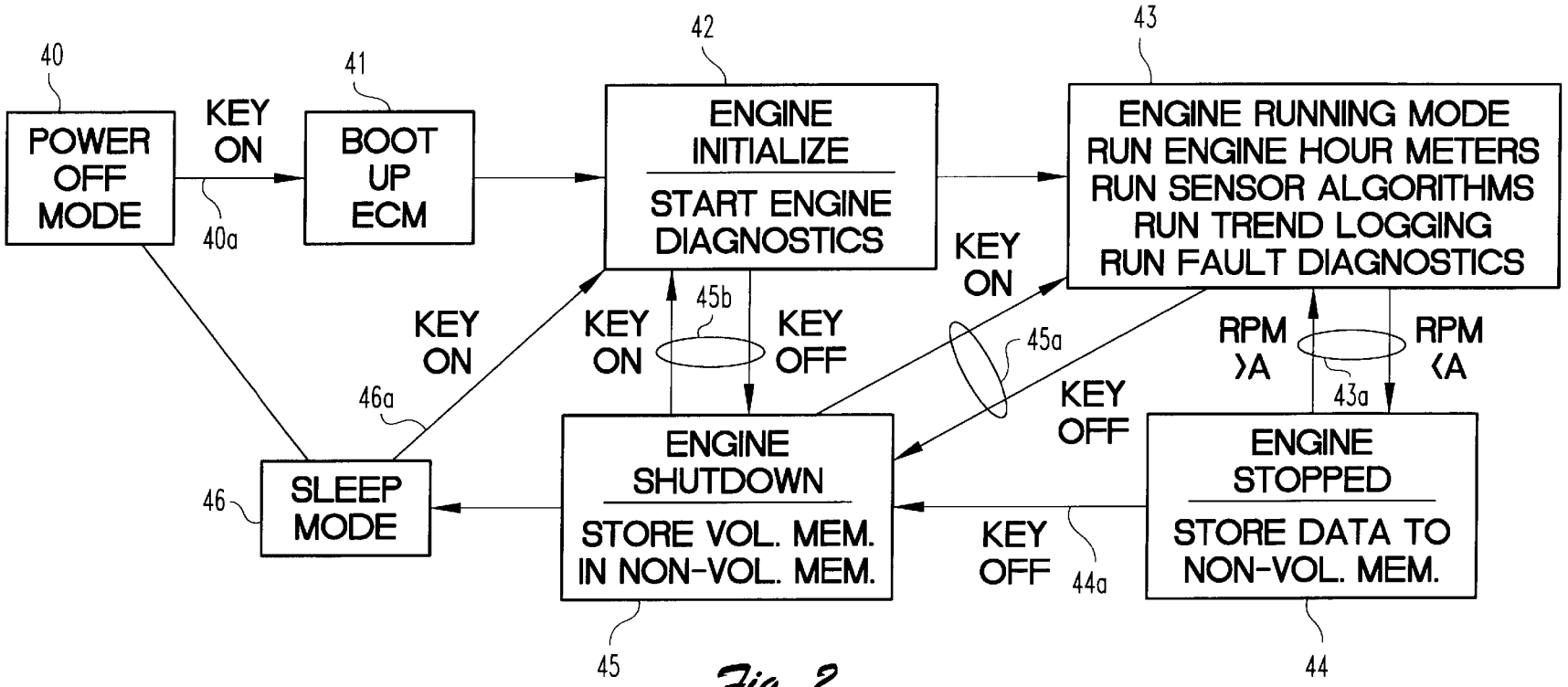
FIG. 2 is a block diagram of the operation of the engine control module depicted in FIG. 1.

During normal engine operation, the ECM 15 performs various engine control functions according to algorithms stored within the ECM. The block diagram of FIG. 2 illustrates one mode of activity for the ECM 15. In particular, the ECM starts in a power off mode 40. When the vehicle key switch 20 is turned to the "on" position, a "key on" signal 40*a* is transmitted to the ECM 15 to begin the boot up step 41. In this step, power is provided to all components of the ECM 15 from the battery 17. In the next step 42, the engine operation algorithms are initialized. In this step, various engine diagnostic activities are commenced. In addition, depending upon the desired operating characteristics of the engine 10, the ECM extracts various operating parameter data from memory and seeds that data into the operating algorithms. For example, this engine operating data can include high and low idle engine speed limits, fuel injection quantities, pressure and temperature threshold values, firing timing data, and the like. In the engine initialization step 42, any changes to these operating parameters are incorporated into the algorithms implemented by the ECM.

In accordance with the preferred embodiment, these engine operating data can be modified by use of an external tool, such as service tool 36 show in FIG. 1. The service tool 36 communicates with the ECM 15 by way of external inputs 31. Various communication protocols can be utilized for the transmission of this data. In many typical engine control modules, an RS232 or RS422 communication link is provided for external communications. Other external communications can be provided over J1587 or J1939 communication links. It is also understood that similar communication protocols can be utilized for communicating data to and from the engine fuel system 23 and the sensors 26. In various embodiments, the service tool 36 can be plugged directly into the corresponding communication link of the ECM 15. In addition, a remote device 35 can be utilized for wireless communication with the ECM 15. With this type of device, the ECM includes a remote interface device connected to the external data lines 31 that permits the wireless communication. For example, the remote device can communicate by infrared signals. Optimally, however, the remote device 35 operates with radio signals. One example of remote communications of this type is found in U.S. Pat. No. 5,619,412 described above.

Returning to the block diagram of FIG. 2, after the engine control module has been initialized at step 42, the ECM 15 moves to its engine running mode 43. In this mode, the ECM runs various engine hour meters to log total engine hours and number of engine hours since the last service stop. The ECM also runs various sensor algorithms that receive sensor signals 25 from the various sensors 26, as well as speed signals 27 from the transmission 28, and compares this data with pre-programmed or externally updated limit values stored within the ECM. The ECM 15 also implements algorithms that run fault diagnostics and calculate engine trend data and duty cycle information. All of this information is at least initially stored in volatile memory 38 of the BCM 15, since the data is continuously updated while the engine 10 is being operated.

While the vehicle is being operated, the ECM 15 is maintained in the engine running mode 43. Under certain conditions, program flow within the ECM is taken away from the running mode 43. For example, at a decision loop 43*a*, if the engine RPM falls below a preset value "A", the ECM moves to an engine stopped mode 44. In this mode, data in the volatile memory 38 is stored in the non-volatile memory 39 of the ECM 15, such as a flash memory, to allow subsequent extraction. The ECM 15 continues to monitor the engine performance even at the lower RPM until either the engine RPM increases to a n acceptable speed, or until a key "off" condition is sensed at test 44*a*.

At a key "off" condition, namely when the vehicle key switch 20 is switched off, the ECM 15 moves to the engine shut down step 45. As shown in FIG. 2, the "off" position can occur at tests 45*a* and 45*b* when the ECM is operating in either the engine initialization mode 42 or the engine running mode 43. In the engine shut down mode 45, the ECM again flushes data from volatile memory 38 to its non-volatile memory 39 for subsequent downloading and evaluation. Of course, as depicted in FIG. 2, if the key switch 20 is moved to the "on" position, control returns to the appropriate mode 42, 43. If engine shut down is maintained, the ECM moves to a sleep mode 46, which again can be exited at decision 46*a* if the vehicle key switch is moved to the "on" position. Once the sleep mode 46 of the ECM 15 expires, the ECM moves to the power off mode 40 in which electrical power to the ECM is terminated. It is understood that even in the power off mode, the ECM may maintain various real time clocks. In addition, certain non-volatile memory components may require some power to maintain their state. Thus, even in the power off mode 40, the ECM is still deriving some small amount of electrical power from the battery 17.

Figure 3A:
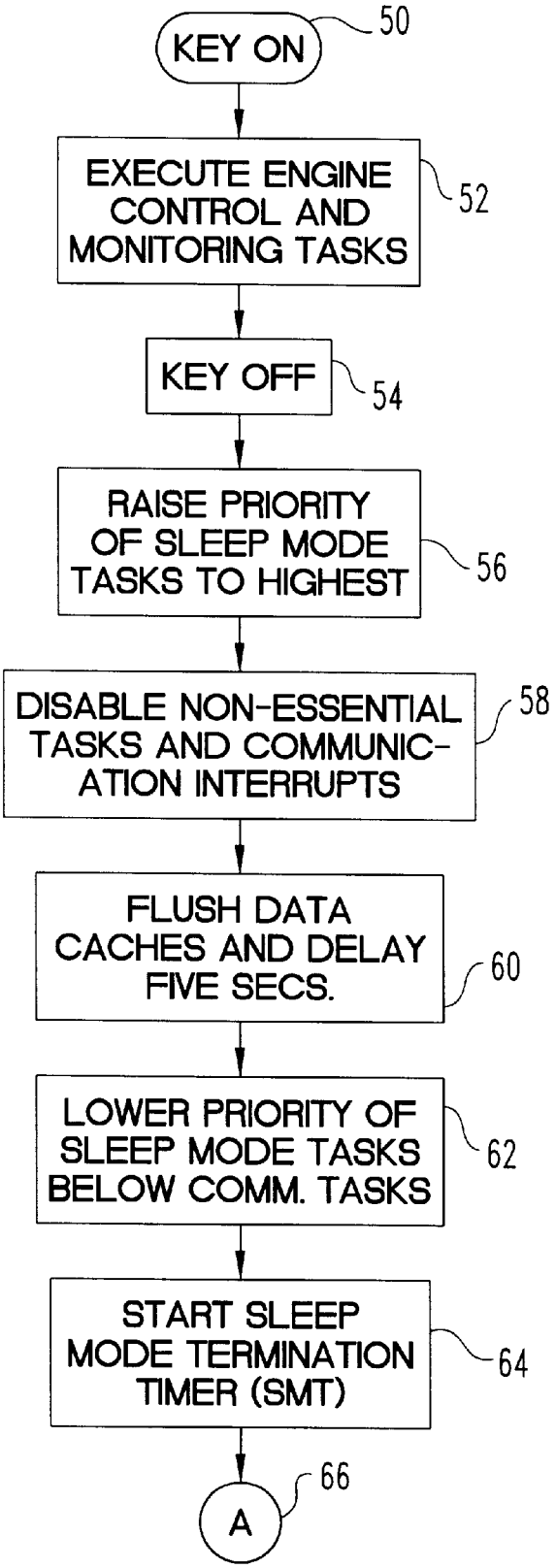
FIG. 3A is a flow chart showing the initial steps of a sleep mode protocol implemented by the system depicted in FIG. 1.

The present invention contemplates improvements to the sleep mode 46 of operation of the ECM 15. The present invention contemplates a sleep mode task module 57 within the ECM that implements steps of a sleep mode algorithm. The steps of this algorithm are shown in the flow charts of FIG. 3A and 3B. Initially, the engine 10 and ECM 15 are in the key "on" condition 50. In step 52 shown in the flow chart of FIG. 3A, the engine control and monitoring tasks are executed by the ECM 15 until a key "off" condition 54 is detected. Thus far, these initial steps are a part of the normal operation of the ECM 15. Once a key "off" condition is detected in step 54, program flow passes to step 56 in which the ECM raises the priority of the sleep mode tasks performed by the sleep mode task module 57 to the highest priority. The ECM task scheduler will operate as described above to determine whether conflicts exists among tasks, evaluate the priority of the conflicting task, and perform the task having the highest priority. In addition, the task scheduler will normally evaluate whether certain high priority tasks are being requested at shorter intervals than lower priority tasks. For example, one high priority task may be to evaluate whether an interrupt has been received from the key switch 20, signaling that the engine is to be shut down. The task scheduler of the ECM 15 may assign this interrupt monitoring task to a very high priority, which provides for continuous monitoring of the interrupt. A lower task may be the calculation of various data that would eventually be downloaded from the ECM. Since any task performed by the ECM diverts attention of the ECM away from other tasks, it may be preferred to assign a lower priority to various data generation tasks of the ECM, as opposed to tasks directly necessary for controlling the operation of the engine 10.

At any rate, in step 56, the ECM 15, and particularly the task scheduler, raises the priority of the sleep mode tasks to the highest level so that no other task will be performed by the ECM. The sleep mode task module 57 then takes over in controlling the operation of the ECM. In the next step 58, the sleep mode task module directs the ECM to disable all other non-essential tasks and communication interrupts. The definition of non-essential tasks can vary depending upon the particular ECM protocol being implemented. For example, non-essential tasks may simply include all data acquisition tasks in which data 21 from the various sensors 26 and 27 are collected and stored. When the engine is shut down, this data is generally no longer being transmitted, so disabling of tasks related to this data acquisition will normally occur. Certainly, other non-essential tasks include the tasks that send control signals 22 to the fuel system 23.

With respect to the communication interrupts, various of the communication modules controlled by the communication processor 30 of the ECM 15 are no longer necessary when the engine has been shut down. For example, some of the sensors 26 may generate interrupts along input sensor signals line 25 to the ECM that cause the monitoring tasks to commence. Disabling these now non-essential interrupts prevents the ECM 15 from acting in response to data signals 25. Again, the definition of non-essential tasks and communication interrupts may vary depending upon the protocol of the particular ECM. It is understood that the present description is simply illustrative of one mode of operation of the sleep task module 57 of the present invention.

In the next step 60, the sleep task module 57 directs that the volatile data caches maintained by the ECM 15 be flushed to non-volatile or flash memory. In other words, in accordance with one embodiment of the invention, the ECM 15 maintains various temporary data caches that are used by various task modules and algorithm steps implemented by the ECM. In anticipation of subsequent use of these data caches, the sleep task module 57 flushes the data caches and then implements a predetermined time delay. In the specific illustrated embodiment, the delay is 5 seconds, which is believed to provide adequate time for all of the data caches to be flushed and reset. When the data caches are flushed, preferably the data is written to a non-volatile memory, such as a flash chip. Certain characteristics of some flash chips may require a longer time to write the data from the data caches to the chip. Consequently, the predetermined time delay is necessary to ensure that all data has been flushed from the caches and written to appropriate flash chips. During this time, all other tasks are interrupted so that the only activity occurring is the flushing of the data caches.

In the next step 62, the sleep mode tasks implemented by the sleep task module 57 are reduced in priority below certain communication tasks. In one important aspect of the present invention, specific external communications are maintained even in the modified sleep mode. In order to effect these communications, various sleep mode tasks must be reduced in priority so that the ECM will be able to monitor and act according to certain specific communication interrupts. On the other hand, the sleep mode tasks will maintain a higher priority than all other tasks that would ordinarily be implemented by the ECM. In some embodiments, as long as power is maintained to the ECM, the ECM will perform various tasks according to the task scheduler, unless the priority of other tasks take precedence. Consequently, the present invention contemplates maintaining the sleep mode task at a high enough priority to overrule any other task, yet a low enough priority to permit various communication tasks to occur.

The sleep task module 57 then starts a sleep mode termination timer (SMT timer) in step 64, with controlled passing to intermediate step 66. The sleep mode termination timer establishes a predetermined duration in which the ECM 15 will be maintained in this modified sleep mode. The length of time counted down by the SMT timer can be preset by the vehicle operator or engine maintenance technician. The sleep mode termination timer establishes the length of time that the ECM 15 will be able to receive communications from external sources. For example, the SMT timer can be set to a time of one hour, which means that the vehicle operator or engine technician will be able to communicate with the ECM at any time within that hour, until the ECM itself is shut down.

Figure 3B:
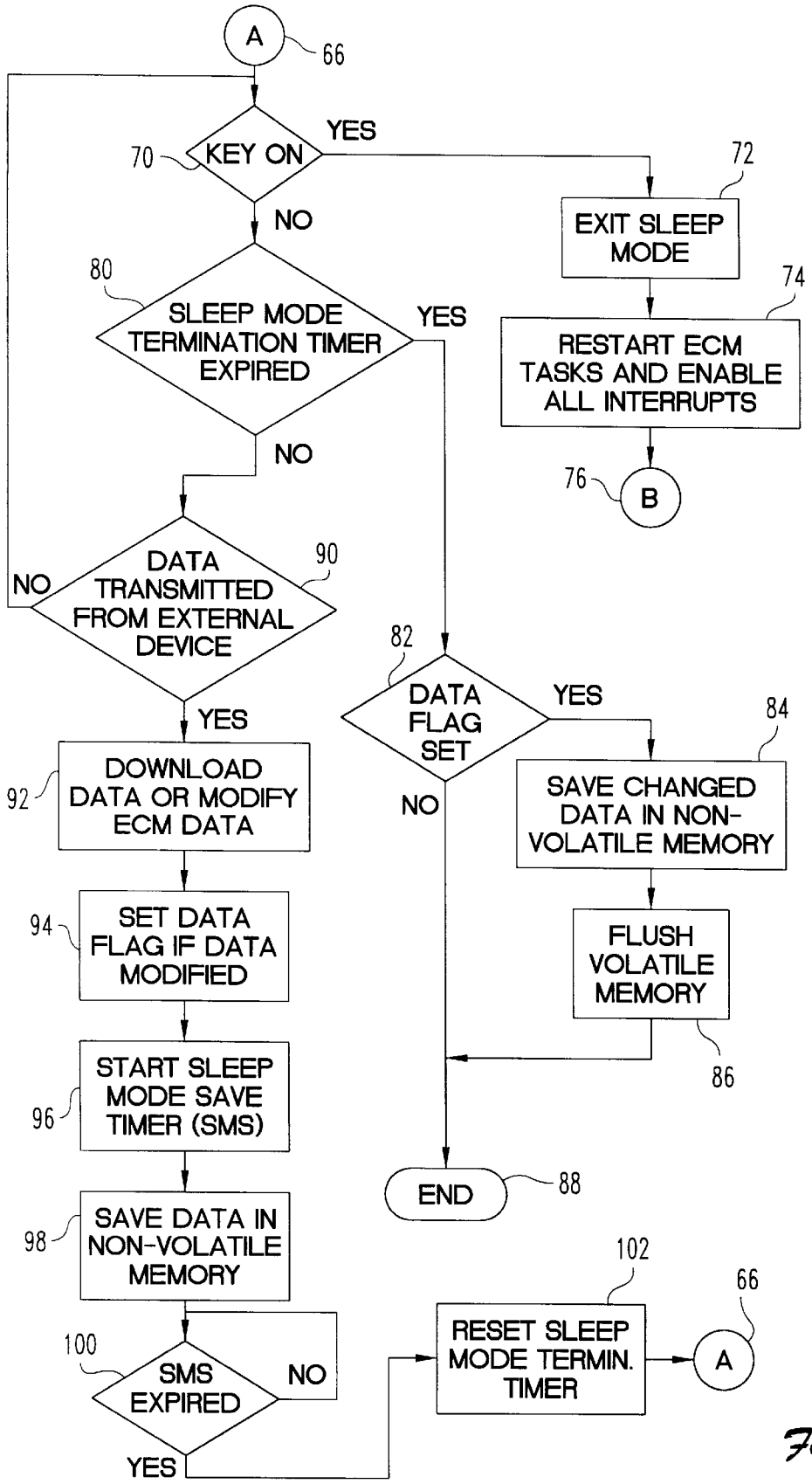
FIG. 3B is a flow chart showing further processing by the system of FIG. 1 in the control modules in the modified sleep mode.

Referring now to FIG. 3B, from the intermediate step 66, a test 70 is made to determine whether the key switch 20 has been switched to the "on" position. If so, then program flow transfers to step 72 in which the sleep mode is exited. At this step, the sleep task module 57 is reduced to the lowest priority so that all other ECM tasks are performed ahead of any sleep mode tasks. In step 74, the ECM is restarted and all other interrupts are enabled. The ECM then transfers to a normal operation mode in step 76, which can correspond to the step 52 previously described.

Alternatively, if the key "on" condition in step 70 is not met, namely that the key switch has not been turned on, then a test 80 is made to determine whether the SMT timer has expired. In accordance with one specific embodiment of the invention, the sleep task module 57 includes a count up timer that counts up until the predetermined sleep mode termination time is met. If this count up timer reaches that time, then the condition step 80 is met, at which point the program control flows to branch step 82. In this step, the sleep mode task module asks whether a data flag has been set. In accordance with the present invention, since external communication is permitted to change data within the ECM memory, a data flag is set by the sleep task module 57 to indicate whether such a data change has occurred. If the answer to condition 82 is no, then the ECM, and particularly sleep task module 57, transfers to program end at step 88. This ending step 88 corresponds to the power off mode 40 illustrated in FIG. 2. On the other hand, if the data flag is set, the program flows to step 84 in which any changed data is stored in non-volatile memory, and step 86 in which the volatile memory is flushed. After those steps have occurred, the program terminates at the end step 88.

If the condition at step 80 is not met, namely that the SMT timer has not expired, then the sleep mode of the ECM continues. In accordance with one aspect of the invention, a condition step 90 determines whether data has been transmitted from an external device. Alternatively, this condition step can be to determine whether an interrupt corresponding to an external device has been received by the communication processor 31 of the ECM 15. If no data has been transmitted, then the condition step 90 branches back to the condition step 70 to determine whether the key switch has been turned to the on position.

According to the algorithm implemented by the sleep task module 57, these three condition steps will be continuously evaluated until one of the three events occurs, namely the key switch is turned on, the SMT timer expires, or a data signal or interrupt is received from an external device. In the circumstance in which the vehicle is in a ready line at a mine site, as described above, it is likely that a key "on" condition at step 70 will be met prior to the expiration of the SMT timer. For example, if the SMT timer is set to one hour, at an operating mine site it is likely that the hauling vehicle controlled by the ECM 15 will be put into operation before that hour expires. On the other hand, if the mine site is not quite that active, or if the vehicle is intended to be finally shut down for the day, the SMT timer will expire in step 80 and the program flow will occur as described up to the end step 88.

During the time that the hauling vehicle is staged in the ready line, the mine site operator, vehicle operator or engine technician may desire to evaluate the operation of a particular engine over its last duty cycle. At that point, then the operator may choose to use one of the external devices 35 or 36, to send and receive data to and from the ECM 15. In this circumstance, the condition at step 90 will be answered yes, meaning that a signal of some type has been received by an external device, such as remote device 35 or service tool 36. Since the communication interrupts for these external devices is maintained at the highest priority, the sleep task module 57, and particularly the ECM 15, will be continuously evaluating the external data signal lines 31 to determine whether such an event has occurred. In a specific embodiment, the condition step 90 can be answered "yes" if a service technician plugs a service tool 36 into an appropriate input connector. Alternatively, the service technician can utilize the remote device 35 to transmit a wireless signal to a receiver controlled by the ECM, which will then generate an interrupt at the communication processor 30 signaling an incoming communication.

When the condition step 90 is answered "yes", the communication processor 30 will determine the nature of the incoming signal. For example, the service tool 36 can be utilized to extract data from the ECM memory, or to change various parameters stored by the ECM. Thus, in step 92, the sleep task module 57 directs various data tasks performed by the ECM 15. In a typical scenario, the technician will first download data from the ECM that is indicative of the engine operating condition. This data can include various trend data logged by the ECM, fault diagnostics, or duty cycle data generated by the ECM while the vehicle is being operated. The fault data can include, for instance, flags that are set when various fault conditions occur during vehicle operation or in particular duty cycle. For example, if the engine has a tendency to overheat, an engine over temperature flag or counter may be set and subsequently downloaded by the engine technician. Likewise, trend data logged by the ECM can show the trend of various sensed parameters during the last period of time of engine operation. In any case, the engine technician can evaluate the downloaded data to determine whether the engine must be pulled for service, or whether some intermediate intervention needs to be taken.

In some instances, the engine operating condition deficiencies or faults can be corrected by changing some of the engine operating parameters. For example, control signals 22 to the fuel system 23 can be modified to adjust engine performance. In this instance, the engine technician will modify various ECM data at step 92. In accordance with the preferred embodiment, as discussed above, the ECM implements engine control algorithms that utilize values set externally by the engine technician. These values can be in the form of multipliers, offset constants or limit values. In accordance with the present invention, the engine technician can make these changes to the ECM parameters even when the engine has been shut down and the ECM 15 is in a modified sleep mode.

If the ECM data is modified, a data flag is set in step 94. This data flag is used when the SMT timer expires, as described above. Once the data flag has been set in step 94, a sleep mode save timer (SMS timer) is started in step 96. The sleep mode save timer 96 can count up or down to a predetermined amount of time that is set to permit saving any data stored in volatile memory within non-volatile memory as shown in the save step 98. In one embodiment, once the data has been selected to be modified by way of the external device 35 or 36, it must be saved from the volatile memory to which it is initially written, to a non-volatile memory 39 of the ECM 15. Thus, if power from the battery 17 is terminated, the changed data is retained by the ECM. Due to various features of the memory and associated hardware, it is often necessary to wait a predetermined period of time to ensure the data has been correctly written to the non-volatile memory. Thus, the SMS timer is set to account for any delays that may arise. In the condition step 100, the sleep task module 57 determines whether the SMS timer has expired. If not, then the sleep task module continually loops on this condition step until it has expired, at which point it is assumed that all of the necessary data has been saved to non-volatile memory in step 98.

Once the data has been saved in step 98 control of the sleep task module 57 can be returned to intermediate step 66, at which point the three essential condition steps 70, 80 and 90 are performed. In this circumstance, the total elapsed time that the ECM 15 spends in the sleep mode will be fixed, as determined by the value of the SMT timer. For example, if the SMT timer is set for one hour, then ECM 15 will spend only one hour in the sleep mode, after which it will move to the power off mode 40 (FIG. 2).

Alternatively, in accordance with one embodiment of the present invention, the sleep mode termination timer is reset in step 102. After this reset, control is sent back to the intermediate step 66 for the three condition steps to be evaluated. With this embodiment, it is not necessary for the engine technician to perform all of the data download and data modification steps within the predetermined SMT timer time period. In the case when the SMT timer is set for one hour, this one hour time period will be continuously recycled as long as data communication is occurring between the ECM 15 and the remote devices 35 or 36. In one scenario, the engine technician can extract data from the ECM indicative of the engine operating conditions over the last duty cycle. This data extraction will cause the sleep mode timer to reset, which then gives the engine technician another predetermined period of time in which to initiate another communication with the ECM. The technician can then take some time to evaluate the engine data and assess what steps need to be taken. If the engine must be serviced or overhauled, the technician can simply allow the sleep mode termination timer to expire, so that control passes from the condition step 80 to the subsequent power off steps.

On the other hand, if the engine operating parameters simply need to be "tweaked," the engine technician can transmit data to the ECM within the SMT timer use set time period. Alternatively, the technician may desire to download additional data from the ECM to help evaluate and diagnose any engine operating problems. With this feature of the invention, the ECM 15 can be maintained in as short a modified sleep mode period as possible. Otherwise, the SMT timer would have to be set to a fairly lengthy time period that would allow the engine technician or vehicle operator to download data, evaluate the data, determine a course of action, and then modify the ECM operating parameters as necessary.

Depending upon the nature of problems that might be met, the SMT timer time period may be fairly length. On the other hand, if the download, evaluation and upload cycle is fairly short, the SMT timer can be set to a fairly short time period, such as fifteen minutes. In the mine site ready line example, it may be that an engine technician will evaluate the engine of each vehicle within one half hour of the arrival of the vehicle at the mine site. In this event, it is not necessary to maintain the ECM in a power draining sleep mode, even in a modified sleep mode, for any significant length of time. Setting the SMT timer for a fairly short period of time will reduce the energy consumption by the ECM and therefore the drain on the battery 17, while still giving the engine technician adequate time to initially download data, and then subsequently upload data to the ECM.

While the preferred embodiment of the invention has been illustrated and described in detail in the figures and accompanying specification, this description is not intended to be restrictive in character. Instead, it is understood that the present invention contemplates changes and modifications to the illustrated embodiment that may arise on consideration by a person of ordinary skill in the art to which this invention pertains.

What is claimed is:

1. An engine control system for controlling and monitoring engine operation in response to execution of a sequence of commands stored onboard the vehicle and modifiable by an external data transmission tool, comprising:

an engine control module (ECM) executing operating commands to monitor engine operation and to control engine operation based upon modifiable operating parameters, and having a memory for storing the modifiable operating parameters and data indicative of monitored engine operating conditions;

a plurality of data links operatively connected to said ECM for the transmission of data to and from said ECM, at least one data link providing communication between said ECM and an external data transmission tool;

a sleep mode task module within said ECM for placing the ECM in a sleep mode of reduced power consumption in which said ECM ceases executing the operating commands, said sleep mode task module including;

a sleep mode termination timer for timing the length of time the ECM is in the sleep mode;

communication processor means within said ECM for permitting communication with the external data transmission tool only over said at least one data link during said sleep mode to access said memory of said ECM to download said data indicative of monitored engine operating conditions or to modify said operating parameters within said memory; and power down means for placing the ECM in a power down state upon expiration of a predetermined time period counted by said sleep termination mode timer.

2. The engine control system according to claim 1, wherein said sleep mode task module further includes means for resetting said sleep mode termination timer upon receipt of data on said at least one data link.

3. The engine control system according to claim 1, wherein said at least one data link includes an RS-232 data port.

4. The engine control system according to claim 3, wherein said at least one data link further includes an RS-232 data port configured for wireless reception of data.

5. The engine control system according to claim 1, wherein said at least one data link includes a J-1939 data port.

6. The engine control system according to claim 1, wherein said communication processor means includes means for disabling interrupts at the ECM associated only with ones of said plurality of data links other than said at least one data link.

7. The engine control system according to claim 1, wherein:

the system includes a vehicle key switch operable to generate an "OFF" signal when the key switch is turned to an off position; and said sleep mode task module is initiated by said ECM when said ECM receives said "OFF" signal from said key switch.

8. The engine control system according to claim 7, wherein:

said ECM includes means for controlling a plurality of task modules that execute the operating commands; and said sleep mode task module includes means for disabling said plurality of task modules after a predetermined period of time after being initiated by said ECM.

9. The engine control system according to claim 7, wherein:

said ECM includes means for controlling a plurality of task modules that execute the operating commands, data caches for temporary storage of data used by said task modules, and a task scheduler for prioritizing operation of said task modules and data communication to and from said ECM; and said sleep mode task module includes means for flushing the data caches, wherein said task scheduler is operable to assign said means for flushing the highest priority for a predetermined period of time and thereafter to assign said at least one data link highest priority and said sleep mode task module next highest priority.

10. The engine control system according to claim 1, wherein:

said ECM includes non-volatile memory for storing data to be read by said ECM when said ECM exits the sleep mode; and said power down means of said sleep mode task module includes means for storing in non-volatile memory operating parameters modified during the sleep mode.

11. In an engine control system having an engine control module (ECM) for controlling and monitoring engine operations, the ECM having a task scheduler and a communication processor for controlling data communications to and from the engine and data communications to and from at least one external data transmission device, a method for placing the ECM in a mode of reduced power consumption comprising the steps of:

monitoring the vehicle key switch to determine if the key switch has been placed in an "off" position; and upon receipt of a key switch "off" signal, disabling non-essential tasks and communications controlled by the ECM;

in the ECM task scheduler, assigning the highest priority within the communications processor to data communications with the at least one external data transmission device;

starting a sleep mode termination timer (SMT timer);

comparing the SMT timer to a predetermined time period;

placing the ECM in a power down mode when the SMT timer counts a time exceeding the predetermined time period; and permitting data communication only between the ECM and the at least one external data transmission device prior to expiration of the SMT timer.

12. The method according to claim 11, further comprising the step of resetting the SMT timer upon receipt by the communication processor of data from the at least one external data transmission device.

13. The method according to claim 11, further comprising the step of using the external data transmission device to download data stored in a memory of the ECM prior to expiration of the SMT timer.

14. The method according to claim 11, further comprising the step of using the external data transmission device to upload data to a memory of the ECM prior to expiration of the SMT timer.

15. The method according to claim 14, including the steps of:

setting a data flag when data is uploaded to the ECM memory;

during the unloading step, receiving the transmitted data into a volatile memory of the ECM;

upon expiration of the SMT timer, saving data changed during the upload into a non-volatile memory of the ECM; and then flushing the volatile memory prior to placing the ECM to the power down mode.

16. The method according to claim 15, wherein the step of saving changed data includes:

starting a save timer;

saving the changed data to non-volatile memory;

comparing the save timer to a predetermined time period; and ending the changed data saving step upon expiration of the save timer.

17. The engine control system according to claim 10, wherein:

said ECM includes a volatile memory;

said communication processor means is operable to upload data to modify said operating parameters into said volatile memory; and said means for storing is operable to upload said data from said volatile memory into said non-volatile memory.

* * * * *

UNITED STATES PATENT AND TRADEMARK OFFICE

CERTIFICATE OF CORRECTION

PATENT NO. : 5,999,876

DATED : Dec.7, 1999

INVENTOR(S) : John Irons; Scott Decker; Greg Greathouse; Irfan Tusneem

It is certified that error appears in the above-identified patent and that said Letters Patent is hereby corrected as shown below:

Col. 6, line 37
replace "BCM"
with --ECM--

Signed and Sealed this

Twenty-seventh Day of June, 2000

*Attest:*

Q. TODD DICKINSON

*Attesting Officer*

*Director of Patents and Trademarks*